United States Patent [19]

Dinardo

[11] 4,233,789

[45] Nov. 18, 1980

[54] STORAGE TANKS

[76] Inventor: Carlo Dinardo, "Teighness", Main St., Killearn, Stirlingshire, England

[21] Appl. No.: 946,701

[22] Filed: Sep. 28, 1978

Related U.S. Application Data

[63] Continuation of Ser. No. 788,934, Apr. 19, 1977, abandoned.

[51] Int. Cl.[2] ..... E02D 27/38

[52] U.S. Cl. ..... 52/169.2; 52/169.7; 52/742; 405/53

[58] Field of Search ..... 405/53, 55, 258, 303; 52/169.2, 169.3, 169.6, 169.7, 742; 220/18; 137/236 R, 376

[56] References Cited

U.S. PATENT DOCUMENTS

| | | | |
|---|---|---|---|
| 26,481 | 12/1859 | Doyere | 405/53 X |
| 2,398,828 | 4/1946 | Gray | 405/53 |
| 2,408,105 | 9/1946 | Starret | 405/55 X |
| 2,507,597 | 5/1950 | Holdridge | 405/53 X |
| 2,629,348 | 2/1953 | Kifferstein | 52/169.6 X |

FOREIGN PATENT DOCUMENTS

| | | | |
|---|---|---|---|
| 850582 | 12/1939 | France | 52/169.6 |
| 1014595 | 12/1965 | United Kingdom | 52/169.3 |

*Primary Examiner*—David H. Corbin

*Attorney, Agent, or Firm*—Gerald J. Ferguson, Jr.; Joseph J. Baker

[57] ABSTRACT

A method of manufacturing a tank farm comprises designating on a map of the terrain in which the tank farm is to be located, elongate strips of ground surface located at different predetermined levels of said terrain, the longitudinal axis of each of which strips, when taken in plan view, substantially conforms to a contour line of the map, forming tank sites in the terrain in the form of shallow trenches corresponding to the location of said strips, constructing on each of said tank sites an elongate tank having its longitudinal axis substantially horizontal, its vertical dimension being substantially the same as the depth of the trench, and covering the tanks with the earthworks excavated from said trenches substantially to restore the contour of the natural terrain.

9 Claims, 5 Drawing Figures

STORAGE TANKS

This is a continuation, of application Ser. No. 788,934, filed Apr. 19, 1977 now abandoned.

This invention relates to a system providing large volume enclosed storage capacity for material, and to a method of constructing such a system. One form of the invention is marketed under the name TERRASTORE.

The invention is concerned particularly with large volume enclosed storage capacity of the order of tens of thousands of cubic meters and greater, as distinct from small volume capacity of the order of hundreds of cubic meters. The storage capacity of the present invention may be provided by a single tank, as will be explained, or by a series of interconnected tanks.

Hitherto, the need to provide storage capacity for fluid such as oil or gas has been met by constructing one or more cylindrical tanks each of which extends upwards from a tank site in the form of a generally flat base or foundation. Usually, such cylindrical tanks are exposed to view, that is their bases or foundations are substantially level with the surrounding terrain in its natural state. Where it is desired partially or fully to conceal such tanks either for environmental or security reasons, the cost of the requisite excavation work, although to some extent dependent upon the geological nature and configuration of the ground, is almost invariably prohibitive. Moreover, there are practical limits to the maximum height of such tanks and the higher the tank the greater is the loading on the tank wall adjacent the base and on the base itself. A hitherto proposed alternative to such tanks is the construction of subterranean storage caverns with natural rock walls. Apart from economic considerations, a principal disadvantage of such storage caverns is that their practicality is highly dependent upon the convenient availability of sites which are geologically suitable.

It is an object of the present invention to provide an improved system providing large volume enclosed storage capacity for material which facilitates control to be exercised over the surrounding terrain for aesthetic purposes, and to methods of constructing such a system.

According to the present invention there is provided a system providing large volume enclosed storage capacity for material, said system comprising a tubular structure resting upon a ground tank site with the longitudinal axis of the tubular structure extending substantially horizontally.

The present invention also provides a system providing large volume enclosed storage capacity for material, said system comprising a tank in the form of an elongate tubular structure having a closing wall at each end thereof, the tank resting upon an elongate ground tank site with the longitudinal axis of the tank extending lengthwise of the tank site.

Further according to the present invention there is provided a system providing large volume enclosed storage capacity for material, comprising an assembly of closed tanks each of which is of elongate configuration resting on an elongate ground tank site, the longitudinal axes of the tanks extending lengthwise of the tank sites, and wherein a plurality of the tanks are disposed substantially end to end so as to form a group the longitudinal axis of which, when taken in plan view substantially conforms to a contour line of the natural terrain on which the system is sited.

The tubular structure may be closed upon itself, for example in the form of a ring, or square, or rectangle, or triangle or any other convenient shape, not necessarily regular. For example, the longitudinal axis of the tubular structure may conform to a contour line of the natural terrain on which the system is sited. Additionally diaphragm separating walls may separate the storage space within a tubular structure into portions.

The tank or tanks may be of any convenient cross-sectional configuration, and conveniently may include a tubular former or lining, and an outer casing of reinforced concrete. The former or lining, for example, may be of a metal or of a plastics material. In a preferred embodiment the former or lining comprises a spiral formation of strip material.

Further, according to the present invention there is provided a method of constructing a system providing large volume enclosed storage capacity for material, said method comprising preparing an elongate ground tank site and constructing in situ a tubular structure resting on said site and the longitudinal axis of the tank extending substantially horizontally.

The present invention also provides a method of constructing a system providing large volume enclosed storage capacity for material, said method comprising preparing an assembly of elongate ground tank sites, a plurality of said sites being arranged end to end such that the longitudinal axis thereof, when taken in plan view, substantially conforms to a natural ground contour line of the terrain in which the system is sited, and constructing in situ tanks of elongate configuration resting on said tank sites with the longitudinal axes of said tanks respectively extending lengthwise of said tank sites.

The present invention further provides a method of manufacturing a tank farm comprising designating on a map of the terrain in which the tank farm is to be located, elongate strips of ground surface located at different predetermined levels of said terrain, the longitudinal axis of each of which strips, when taken in plan view, substantially conforms to a contour line of the map, forming tank sites in the terrain in the form of shallow trenches corresponding to the location of said strips, constructing on each of said tank sites an elongate tank having its longitudinal axis substantially horizontal, its vertical dimension being substantially the same as the depth of the trench, and covering the tanks with the earthworks excavated from said trenches substantially to restore the contour of the natural terrain.

The, or each, said ground tank site may comprise a strip of ground generally level with adjacent ground, or a trench. The natural terrain may take any shape, for example, substantially flat, or undulating or may be in the form of a hillside.

The longitudinal dimension of the, or each, tank or tubular structure in accordance with the present invention is determined principally and simply by volumetric requirements, the height of the tank or tubular structure conveniently being substantially constant. In this way design parameters remain constant regardless of storage volume in contra distinction to the prior art and, therefore, for any chosen tubular cross-section of tank or tubular structure regardless of axial length.

Exemplary embodiments of the present invention will now be described with reference to the accompanying drawings in which.

Figure 1:
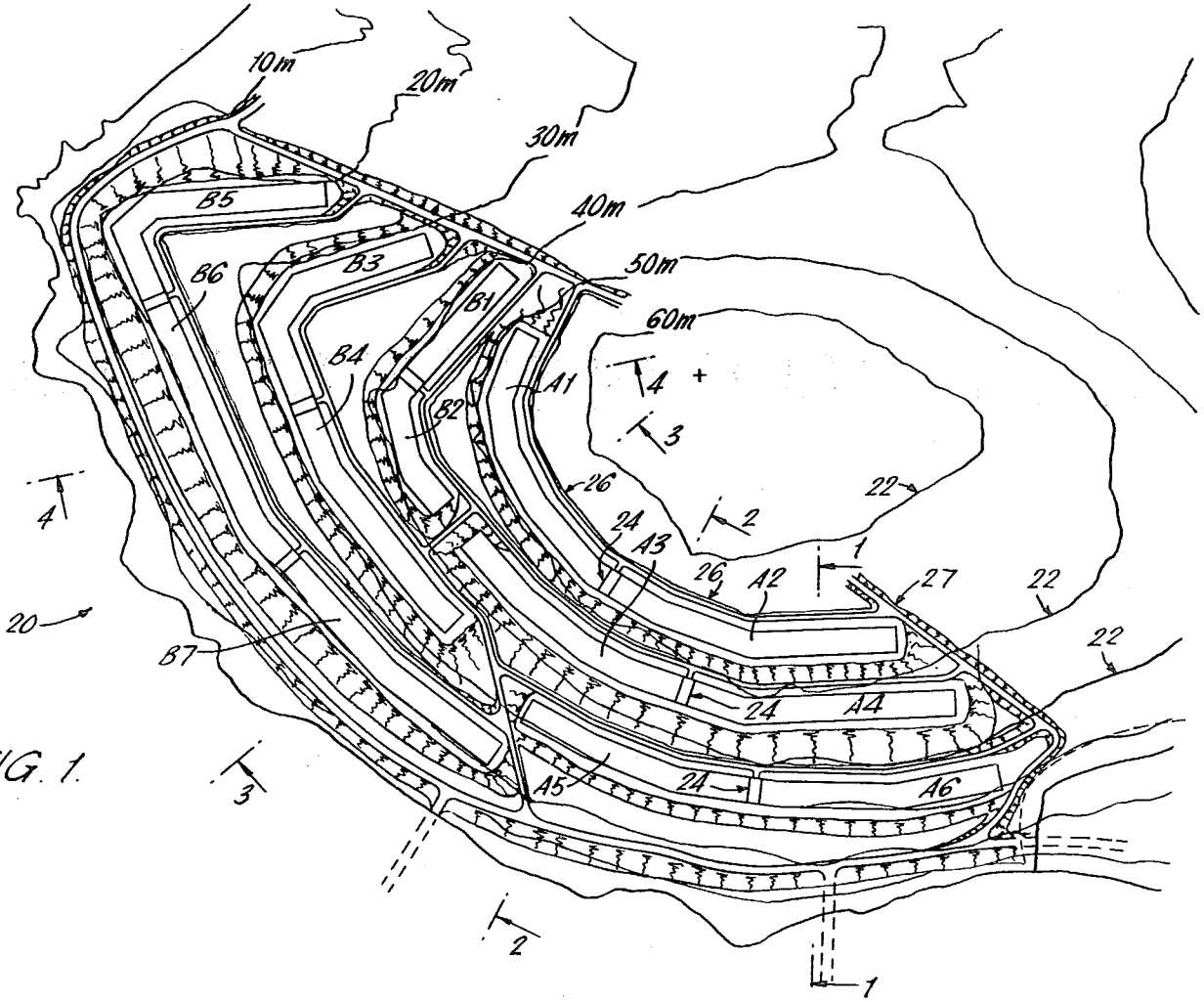
FIG. 1 is a plan view of a system according to the present invention.

In FIG. 1 there is shown a map of terrain in which a tank farm 20 is located. The tank farm 20 is formed by an assembly of closed tanks designated A1 to A6 and B1 to B7 and each tank is in the form of an elongate tubular structure such as A1 having a closing wall at each end thereof. On the map there are designated contour lines 22 of the natural terrain at 10 m intervals, each line 22 being the locus of points on the surface of the natural terrain (i.e. prior to earthworks being initiated to house the tank farm 20) which are at a predetermined height above sea level. Consequently, it will be appreciated that terrain lying on a particular contour line 22 is horizontal. Each of the tanks A1 to B7 in FIG. 1 has its longitudinal axis, when taken in plan view, substantially conforming to a contour line. Thus, for example, the tank B4 has its longitudinal axis extending substantially parallel to and midway between the 30 m and the 40 m contour lines which is therefor conforming to a non-depicted contour line at the 34 m or 35 m level.

Also in FIG. 1, the tanks of the assembly are arranged in groups with the individual tanks thereof disposed substantially end-to-end, as depicted for example by the group formed by tanks A1 and A2 or the group formed by tanks B5, B6 and B7. Adjacent ends of the tanks in each group accommodate valving assemblies 24 for the tanks to permit the supply or discharge of flowable material, e.g. in liquid or gaseous form to or from the tanks, and access roads 26 for the valving assemblies 24 extend substantially parallel to the tanks of each group and communicate with main access roads 27 for the tank farm 20. Feeder pipelines communicating either in series or parallel with the tanks may be used to supply or discharge flowable material.

Figure 2:
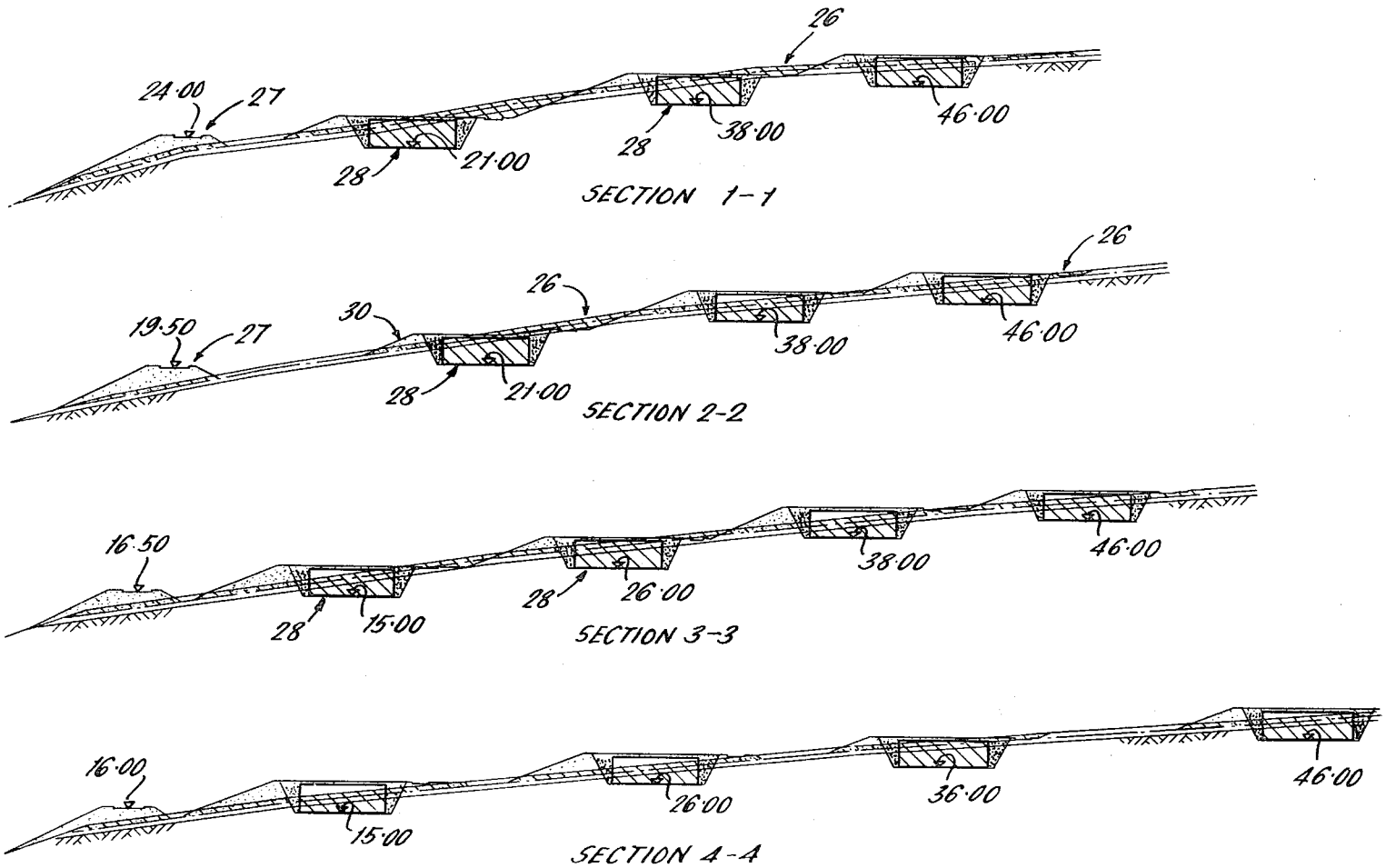
FIG. 2 shows four cross-sectional elevation views respectively taken on lines 1—1, 2—2, 3—3 and 4—4 of FIG. 1.

FIG. 2 shows four cross-sectional elevational views of the tank farm 20 of FIG. 1 and illustrates the relative levels of roads 26, 27 and the upper surfaces of the various tanks A1–6 and B1–7. It will be noted that each tank rests upon an elongate tank site 28 such that the longitudinal axis of the tank extends lengthwise of the tank site 28 which is in the form of a trench and the vertical dimension of the tank is substantially the same as the depth of the trench. The invert levels of the tanks are also marked. The earthwork excavated from said trenches is used to form artificial banking 30 and to cover the tanks to provide resistance to extreme climatic changes such as temperature variations. The sides of the trenches are infilled with free draining material.

Figure 3:
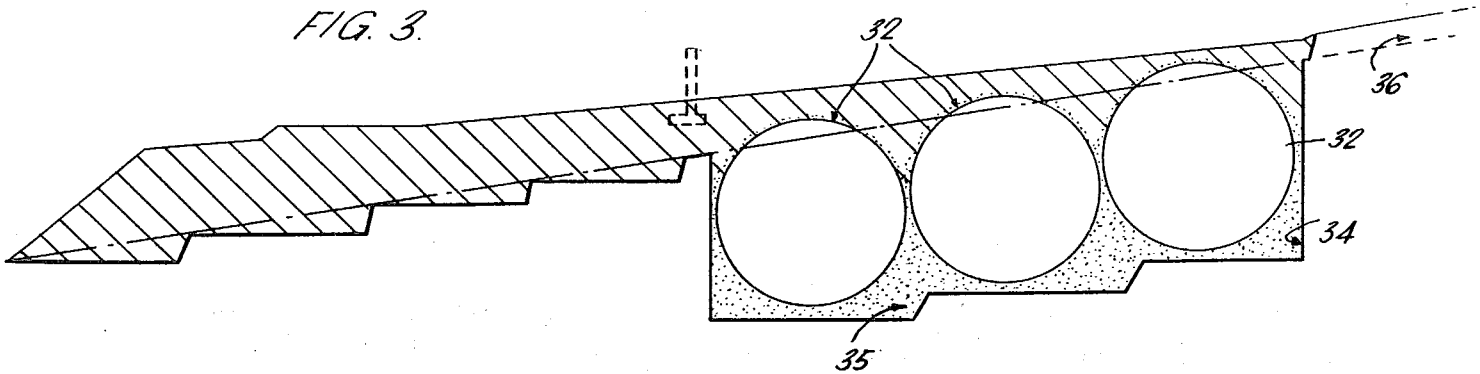
FIG. 3 is a sectional elevation view showing a modification of a detail.

FIG. 3 shows a modified arrangement comprising three tanks 32 each of circular cross-section arranged side by side in a common trench 34 which extends along a predetermined contour line of the natural terrain, the trench having a stepped bed profile 35 which forms three side-by-side tank sites. The outline of the natural terrain is indicated at 36.

Figure 4:
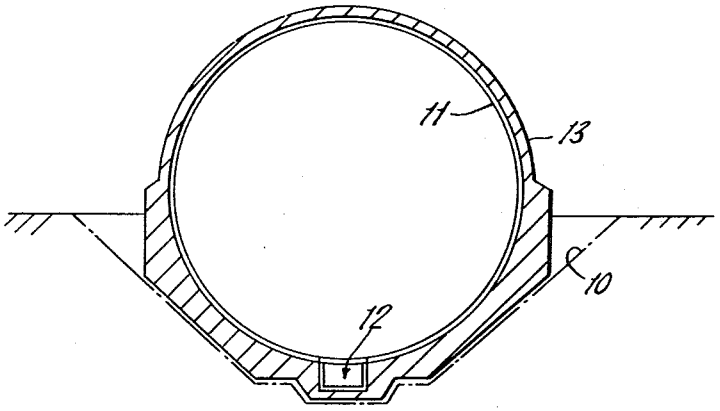
FIGS. 4 and 5 illustrate different forms of tanks in cross-sectional diagrammatic form.

In constructing the system described above elongate tank sites are first formed in or on the ground and thereafter tanks are constructed in situ resting on the prepared tank site. For example, as depicted in FIG. 4, a ground tank site of elongate configuration and desired length is prepared in trench form to the chain-dotted outline 10. A cylindrical steel liner or former 11 is formed in situ using a continuous forming process whereby steel strip is wound to a spiral configuration with adjacent edges of the strip being joined in a folded seam. Such a process is described in British and other patent specifications in the name Xaver Lipp, a German citizen. Sumps, of which one is indicated by reference numeral 12, are provided at spaced intervals along the liner or former 11 and a reinforced concrete casing 13 is formed on the outer surface of the liner or former 11. The storage tank is completed by the provision of closing walls (not shown) at each end. During the formation of the casing 13, internal supports (not shown) are placed within the liner or former 11 and these temporary supports are removed when the concrete casing is set. The liner or former 11 remains in place as a permanent tank lining. A concrete covering could also be formed internally of the liner 11.

Figure 5:
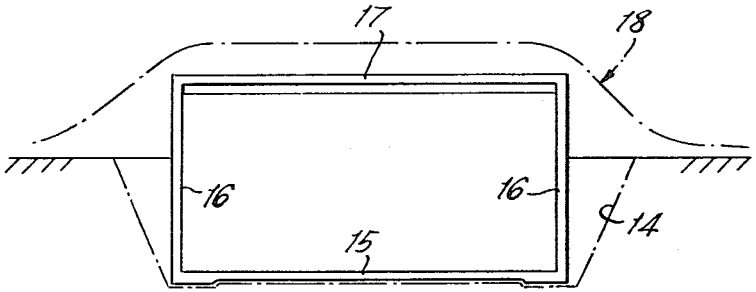

In another example as depicted in FIG. 5, a ground tank site of elongate configuration and desired length is prepared in trench form to the chain-dotted outline 14, and a tank is constructed in situ, having a reinforced concrete base 15 and reinforced side walls 16. A tank roof 17 is formed of precast concrete beams and slabs which may be manufactured off site, and the roof is completed with an in situ concrete topping cast over reinforcement projecting from the precast units. A corrosion-resistant lining (not shown) is applied, if required, to the internal surfaces of the base, walls and roof and the tank is completed by the provision of closing walls (not shown) at each end. If required, a covering 18, of soil is placed over the exposed upper portion of the tank. It will of course be appreciated that all concrete components could be precast and simply jointed in situ.

The tank sites may be self-bunded by the provision of a continuous heavy-duty plastics membrane (e.g. PVC) laid immediately beneath the tanks and extending up any trenching to ground level. Alternatively, or additionally, prevention of egress of the liquid in the tanks may be achieved by providing an external water jacket extending the complete length of each tank to exert a hydrostatic pressure over the surface of the jacket. The head of water pressure may be maintained constant either hydrostatically or by means of a ram. Where the tanks are filled with oil should any leakage of oil and water occur the water acts as a dilutant for the waste oil.

It will be appreciated from the foregoing that the described systems permit a high storage/land utilisation ratio to be obtained and deep excavations are avoided so that unknown geological formations can be avoided and soil loading forces are relatively nominal. It is envisaged that tubular structures or tanks would have manageable heights of 10 m approx. Additionally, after completion of the system the terrain may be landscaped to almost any desired extent, and in particular the configuration of the original terrain can be maintained relatively undisturbed.

The original terrain may be above or below sea level and the material to be stored may be in any form, not necessarily fluid. By way of example only, oil or liquid ammonia could be stored. In this latter case the tubular structure or tank could be covered externally with a layer of thermal insulation with a metal covering.

The above described system is advantageous in that it permits ready access to all parts of the storage capacity and this is particularly convenient for purposes of chemical control and fire or explosion proofing of the system. Conveniently this latter function can be achieved by utilising a replacement gas or liquid of a non-flammable nature in the void above the stored material.

Preferred embodiments of the system according to the present invention have additional advantages, namely (i) they can be located substantially below the level of the natural terrain which is environmentally desirable;

(ii) concrete covering can be manufactured from excavated rock thereby reducing the cost of erection;

(iii) because the height of the tanks is restricted complexity of erection technology is reduced and erection can be effected under cover;

(iv) limitation in height of the tanks produces low stresses in the tank site and therefore soil settlements are reduced;

(v) because the tank site is of minimal complexity site preparation costs are reduced.

What is claimed is:

1. A system providing large volume enclosed storage capacity for material, comprising an assembly of closed tanks disposed at different levels of the natural terrain on which the system is sited, each of said closed tanks being of restricted height and of elongate configuration resting on respective elongate ground tank sites, the longitudinal axes of the tanks extending horizontally and lengthwise of the tank sites, and wherein a plurality of the closed tanks at one of said levels of the terrain are disposed substantially end to end and separated from one another so as to form a group and wherein the longitudinal axis of at least one of said closed tanks is curvilinear when taken in plan view so as to substantially conform to a curvilinear contour line of said natural terrain on which the said one closed tank is sited, each said tank including a plurality of longitudinally-extending containment barriers at least one of which is made of concrete.

2. A system as in claim 1 where said large volume enclosed storage capacity is at least approximately tens of thousands of cubic meters.

3. A system as claimed in claim 1, wherein each of said tanks is covered by earthworks.

4. A system as claimed in claim 1, wherein each of the tanks in said group has a common bottom level.

5. A method of constructing a system providing large volume enclosed storage capacity for material, said method comprising preparing an assembly of elongate ground tank sites at different levels of the natural terrain on which the system is to be sited, a plurality of said sites at one of said levels of the terrain being arranged end to end and separated from one another such that the longitudinal axis thereof, when taken in plan view, substantially conforms to a natural ground contour line of the terrain in which the system is sited, and constructing in situ closed tanks of restricted height of elongate configuration resting on said tank sites with the longitudinal axes of said tanks respectively extending lengthwise of said tank sites and, when taken in plan view substantially conforming to a contour line of the natural terrain on which the system is sited and wherein the longitudinal axis of at least one of said closed tanks is curvilinear when taken in plan view so as to substantially conform to a curvilinear portion of the contour line at the predetermined level at which said one closed tank is constructed, said structure including a plurality of longitudinally-extending containment barriers at least one of which is made of concrete.

6. A method as claimed in claim 5, wherein each tank site is formed by trenching and after construction of the tanks the excavated earthworks from said trenching is distributed about said tanks.

7. A system as in claim 5 where said large volume enclosed storage capacity is at least approximately tens of thousands of cubic meters.

8. A method of manufacturing a tank farm comprising designating on a map of the terrain in which the tank farm is to be located, elongate strips of ground surface located at different predetermined levels of said terrain, the longitudinal axis of each of which strips, when taken in plan view, substantially conforms to a contour line of the map, forming tank sites in the terrain in the form of shallow trenches corresponding to the location of said strips, constructing on each of said tank sites an elongate, closed tank having its longitudinal axis substantially horizontal, its vertical dimension being substantially the same as the depth of the trench, wherein a plurality of the closed tanks at one of said levels of the terrain are disposed substantially end to end and separated from one another and wherein the longitudinal axis of at least one of said closed tanks is curvilinear when taken in plan view so as to substantially conform to a curvilinear portion of the contour line at the predetermined level at which said one closed tank is constructed, and covering the tanks with the earthworks excavated from said trenches substantially to restore the contour of the natural terrain, each said tank including a plurality of longitudinally-extending containment barriers at least one of which is made of concrete.

9. A system as in claim 8 where the volume capacity of said tank farm is at least approximately tens of thousands of cubic meters.

* * * * *